US007694863B2

(12) United States Patent
Spasov et al.

(10) Patent No.: US 7,694,863 B2
(45) Date of Patent: Apr. 13, 2010

(54) HAND-HELD DRIVE-IN TOOL

(75) Inventors: Robert Spasov, Schaan (LI); Matthias Blessing, Frastanz (AT); Hans Gschwend, Buchs (CH); Ulrich Schiestl, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 121 days.

(21) Appl. No.: 11/986,411

(22) Filed: Nov. 20, 2007

(65) Prior Publication Data

US 2008/0121404 A1 May 29, 2008

(30) Foreign Application Priority Data

Nov. 27, 2006 (DE) ..... 10 2006 035 460

(51) Int. Cl.
*B25D 17/00* (2006.01)

(52) U.S. Cl. ..... 227/132; 227/119; 227/134; 227/146; 227/8; 227/27

(58) Field of Classification Search ..... 227/132, 227/5–7, 119, 134, 146, 8, 27
See application file for complete search history.

(56) References Cited

U.S. PATENT DOCUMENTS 1,845,671 A 5/1929 Metcalf
3,589,588 A * 6/1971 Vasku ..... 227/132
3,780,417 A * 12/1973 Reynolds ..... 29/235
4,183,453 A * 1/1980 Barrett et al. ..... 227/131
4,511,074 A * 4/1985 Kille et al. ..... 227/113
4,724,992 A * 2/1988 Ohmori ..... 227/146
5,004,140 A * 4/1991 Fushiya et al. ..... 227/8
5,118,023 A * 6/1992 Fushiya et al. ..... 227/8
5,605,268 A * 2/1997 Hayashi et al. ..... 227/8
5,772,096 A * 6/1998 Osuka et al. ..... 227/5
5,927,585 A * 7/1999 Moorman et al. ..... 227/132
6,971,567 B1 * 12/2005 Cannaliato et al. ..... 227/2
6,997,367 B2 * 2/2006 Hu ..... 227/132
7,000,294 B2 * 2/2006 Kakuda et al. ..... 227/120
2002/0117531 A1 * 8/2002 Schell et al. ..... 227/8
2008/0047999 A1 * 2/2008 Berry et al. ..... 227/7
2008/0121678 A1 * 5/2008 Spasov et al. ..... 227/132
2008/0173689 A1 * 7/2008 Spasov et al. ..... 227/132
2009/0071998 A1 * 3/2009 Nakano et al. ..... 227/8

FOREIGN PATENT DOCUMENTS

DE 3237087 4/1984

* cited by examiner

*Primary Examiner*—Brian D Nash
(74) *Attorney, Agent, or Firm*—Abelman, Frayne & Schwab

(57) ABSTRACT

A hand-held drive-in tool for driving fastening elements (60) in a workpiece (U) includes a drive-in ram (13) for driving the fastening elements (60) in the workpiece (U), at least one drive spring member (31) for driving the drive-in ram (13), a preloading device (70) for the drive-in ram (13) and the drive spring member (31), a locking device (50) which retains the drive-in ram (13) and the drive spring member (31) in a preloaded position (33) when the locking device is located in its locking position (54), an actuation switch (19), for initiating the drive-in process for displacing the locking device (50), and into a release position (55) thereof, and at least one further switch for displacing the locking device (50) in the release position thereof (55) independent from actuation of the actuation switch (19).

10 Claims, 2 Drawing Sheets

HAND-HELD DRIVE-IN TOOL

BACKGROUND OF THE INVENTION

1. Field of the Invention

The present invention relates to a hand-held drive-in tool for driving fastening elements in a workpiece and including a guide, a displaceable drive-in ram for driving the fastening elements in the workpiece, at least one drive spring member for driving the drive-in ram, a preloading device for the drive-in ram and the drive spring member, a locking device having a locking position in which the locking device retains the drive-in ram and the drive spring member in a preloaded position, and an actuation switch imitating a drive-in process and for displacing the locking device in a release position thereof.

2. Description of the Prior Art

The drive-in tool of the type described above can be, e.g., electrically driven, with the drive spring member, which can be preloaded by an electrically driven, preloading device, serving as an energy accumulator. The advantage of such drive-in tools consists in their simple and easily produced construction.

A drive-in tool of the type described above, which is formed as an electric tacker, is disclosed in German Publication DE 32 37 087 A1. In this drive-in tool, a drive-in ram, which is formed as a firing pin, is displaced by a rotatable electric motor in a preloaded position against a biasing force of a drive spring member. The driving connection between the drive-in ram and the electric motor is so formed that he drive-in ram is decoupled from the motor in its preloaded position in which the drive-in ram is held by a locking member. To initiate a drive-in process, an actuation switch, such as an actuation lever or a pressure button should be actuated. Upon actuation of the actuation switch, the locking member is displaced from its locking position in which it retains the drive-in ram in its preloaded position, to a release position. The fastening elements, which are driven in by the electric tacker are stored in a magazine.

The drawback of the known drive-in tool consists in that when no drive-in process is actuated, e.g., when the drive-in tool after being pressed against a workpiece, is lifted off again, without the actuation of the actuation switch, the drive spring member remains preloaded, that can lead to spring fatigue.

Drive-in tools such as described above, electric tacker, have, as a rule, a very small drive-in energy of about from 5 to 10J. Should there be provided such drive-in tool with a greater drive-in energy of up to 80J, a corresponding adaptation or scaling of the drive spring member becomes necessary, which significantly increases the danger of fatigue if the drive spring member remains in preloaded condition for a long period of time.

Accordingly, an object of the present invention is to provide a drive-in tool of the type described above in which the above-discussed drawback of a known tool is eliminated.

SUMMARY OF THE INVENTION

This and other objects of the present invention, which will become apparent hereinafter, are achieved by providing in drive-in tool of the type described above at least one further switch for displacing the locking device in the release position independent from actuation of the actuation switch. The further switch permits to transfer the drive spring member into a release position independent from actuation of the actuation switch, so that the drive spring member is not subjected to fatigue in case of a long non-use.

Advantageously, the at least one further switch is an electric switch for controlling the electrically actuated locking device. The control of the locking device, in this case, can be affected directly or indirectly, using other electronic parts or components. The electronic control insures an error-free and rapid transmission of a switching command.

Advantageously, the at least one further switch is formed as a time switch that actuates the locking device in a time-controlled manner. Thus, upon non-actuation of the actuation switch for a time period that exceeds a predetermined length of time, the drive spring member is transferred in a release position.

According to an advantageous embodiment of the invention, the time switch is formed as an analog electronic timer that can be connected with the control electronics of the drive-in tool in a technically simple manner.

According to an alternative embodiment, the time switch can be formed as a digital electronic timer that likewise can be connected with the control electronics of a drive-in tool in a technically simple manner. The digital timer can be formed, e.g., as a program that runs in a microprocessor of the control unit of the drive-in tool.

Advantageous, the at least one further switch is the main switch of the drive-in tool that turns the tool on and off. In this case, the drive spring member is automatically transferred to its release position upon turning of the main switch off, as the turning of the main switch off leads to displacement of the locking device to its release position.

The main switch can be used as an alternative of the time switch or in addition thereto. The main switch can be actuated dependent on power supply, i.e., in response to the accumulator or the battery being taken out of its receptacle. As a main switch in the sense of the invention, in addition to a physically available switch or sensor, a battery or an accumulator can be considered which opens the current circuit upon being taken out of its receptacle.

It is advantageous when the preloading device functions, in addition to preloading of the drive-in ram and the drive spring member, as braking means for the drive-in ram. The actuation of the preloading device as braking means takes place in response to the switch signal of the further switch means, e.g., of the time switch or the main switch. Thereby, the drive spring member can be released in a controlled manner, so that the energy, which is stored in the drive spring member, can be released in a control manner. This insures that the releasable energy does not negatively influences the service life of the tool components.

Advantageously, there is provided a press-on switch for generating a control signal and having an initial position and an actuation position in which it generates a control signal. The locking device is displaced in its release position upon actuation of the at least one further switch only when the press-on switch occupies its initial, non-actuating position. This prevents release of the drive spring member during a respective operation of the drive-in tool. The untimely release of the drive spring member can result in an erroneous functioning.

Advantageously, the at least one further switch is the press-on switch. In this case, the locking device is released in response to the press-on switch moving to its initial position, i.e., upon lifting of the drive-in tool off the workpiece.

The novel features of the present invention which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
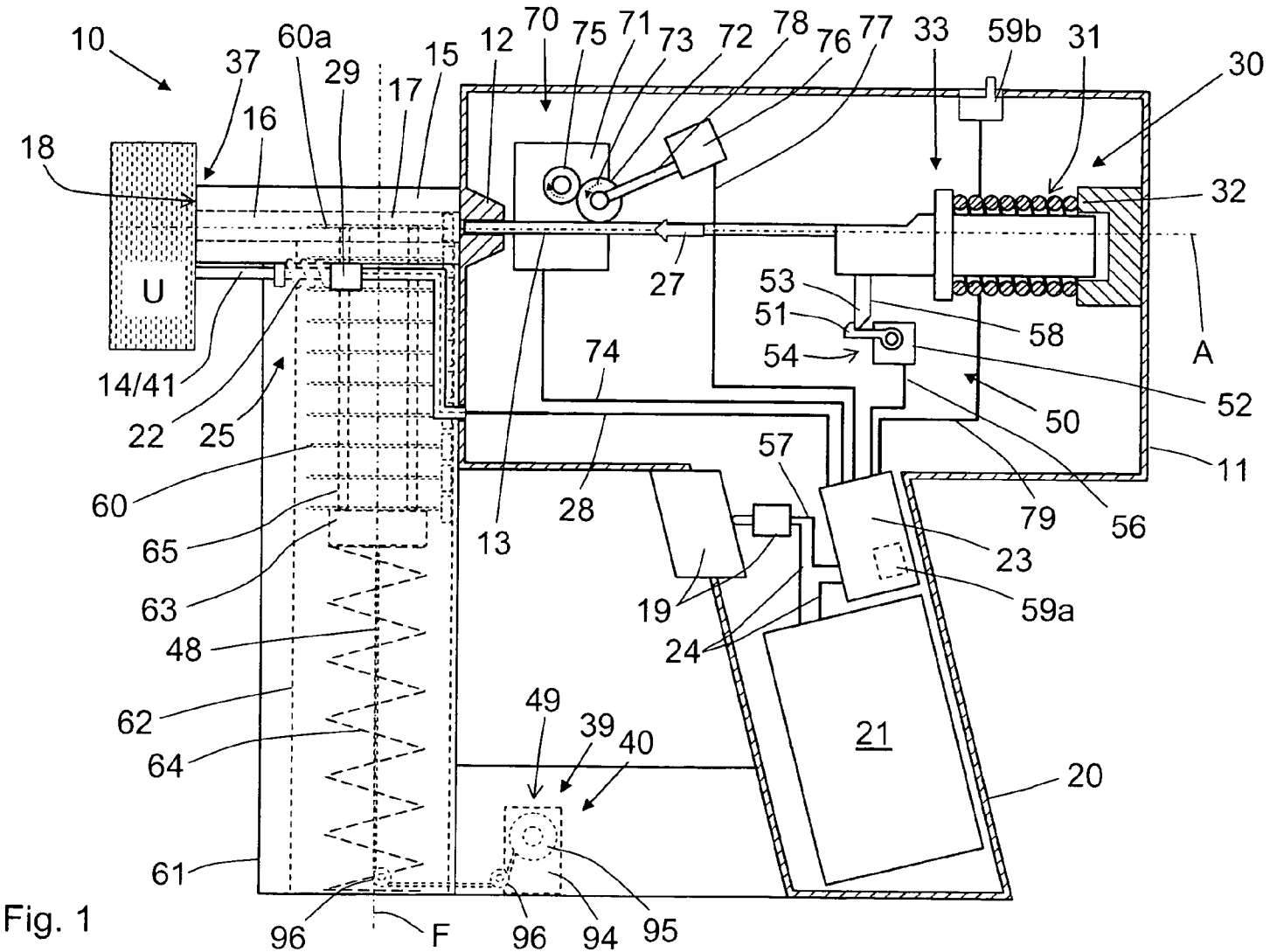
FIG. 1 a longitudinal cross-sectional view of a drive-in tool according to the present invention in a position in which the tool is pressed against a workpiece.
Figure 2:
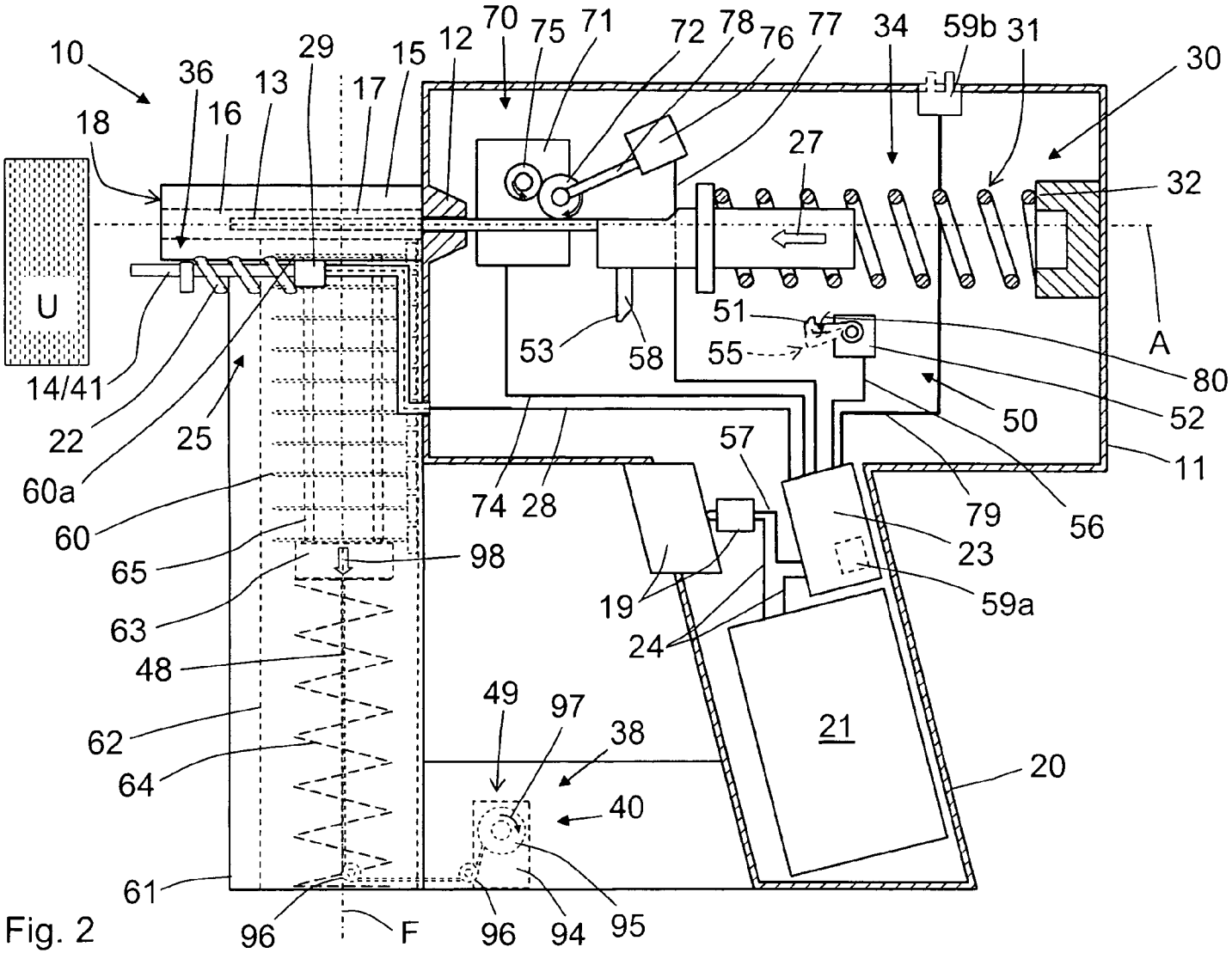
FIG. 2 a view similar to that of FIG. 1 in a position of the tool in which the tool is lifted off the workpiece.

A drive-in power tool 10 according to the present invention, which is shown in FIGS. 1-2, is electrically driven and includes a housing 11, a guide 12 located in the housing 11, a drive-in ram 13 displaceable in the guide 12, and a drive unit for displacing the drive-in ram 13 and generally designated with a reference numeral 30.

A muzzle part 15, which extends coaxially with the drive-in ram guide 12, adjoins the guide 12 at an end of the guide 12 facing in the drive-in direction 27. The muzzle part 15 has a drive-in channel 16 which defines a receiving space 17 for fastening elements 60. Sidewise of the muzzle part 15, there is arranged a magazine 61 for the fastening elements 60. The magazine 61 has a guide channel 62 which extends along a guide axis F and in which a carrier strip 65 that carries the fastening elements 60, is stored. The guide channel 62 opens into the receiving space 17. The carrier strip 65, together with the fastening elements 60, is biased in the direction of the receiving space 17 by a transporting slide 63 which is, in turn, biased by a transporting spring 64 likewise in the direction of the receiving space 17.

The drive unit 30 includes a drive spring member 31 that has one of its ends indirectly supported against the housing 11 via a support element 32, with the other, opposite end of the drive spring member 31 engaging the drive-in ram 13.

In FIG. 1, the drive-in tool 10 is pressed against a workpiece U such as, e.g., a constructional element. In FIG. 1, the drive-in ram 13 is located in a drive-in-ready position in which the ram 13 is elastically preloaded against the drive spring member 31 that is located in its preloaded condition 33. The drive-in ram 13 is displaced in its drive-in-ready position upon the drive-in tool 10 being pressed against the workpiece U as a result of which, a preloading device 70, which would be described in more detail below, is actuated.

The drive-in ram 13 is held in the drive-in-ready position by a locking device generally designated with a reference numeral 50. The locking device 50 has a pawl 51 that engages, in a locking position 54 (see FIG. 1), a locking surface 53 of a projection 58 of the drive-in ram 13, retaining the drive-in ram 13 against the biasing force of the drive spring member 31. The pawl 51 is supported on a servo motor 52 that displaces the pawl 51 in a release position (not shown in the drawings). A first control conductor 56 connects the servo motor 52 with the control unit 23.

The drive-in tool 10 further includes a handle 20 on which an actuation switch 19 is arranged. The actuation switch 19 initiates a drive-in process with the drive-in power tool 10. In the handle 20, a power source 21, which supplies the drive-in tool with electrical energy, is located. Generally, the power source 21 has at least one accumulator. The power source 21 is connected by electrical feeding conductors 24 both with the control unit 23 and the actuation switch 19. A switching conductor 57 connects the control unit 23 with the actuation switch 19, and a main switching conductor 79 connects the control unit 23 with a main switch **59*b* for turning the drive-in tool on and off. A time switch 59*a* which in the embodiment of the invention described here, is formed as an analogue timer, is integrated in the control unit 23. The time switch 59*a* is formed for actuating the locking device 50 that would be described even in more detail below. An analogue timer is a circuit that, e.g., is controlled by a condenser upon expiration of a predetermined time period and that outputs an electrical switching command by a predetermined point in time. Instead of being formed as an analogue timer, the timer switch 59*a* can be formed as a digital timer, e.g., when the control unit 23** is formed as a microprocessor or at least contains a microprocessor. In this case, the digital timer can be a program that is processed in the microprocessor or run therein.

The muzzle part 15 of the drive-in tool 15 is provided with a press-on member 14, which is formed as a press-on feeler 41 and forms part of a safety device 25. The press-on member 14 actuates a press-on switch 29 of the safety device 25 and which is connected with the control unit 23 by an electrical switching conductor 28. The press-on switch 29 sends an electrical signal to the control unit 23 as soon as the drive-in tool 10 is pressed, with the muzzle 18 of the muzzle part 15, against the workpiece U, as shown in FIG. 4. Thus, the press-on switch 29 insures that the drive-in tool 10 can only then be actuated when it is properly pressed against the workpiece U. The press-on member 14 is displaceable along axis A. which is defined by the drive-in channel 16, between an initial position 36 (see FIG. 2) and a press-on position 37 (FIG. 1). The press-on member 14 is biased to its initial position by a spring 22.

As it has already noted above, the drive-in tool 10, includes a preloading device 70. The preloading device 70 has an electrically driven motor 71 that drives a driving roller 72. The motor 71 is connected by a second control conductor 74 with the control unit 23. The control unit 23 actuates the motor 71, e.g., when the control unit 23 is actuated in response to actuation of the press-on switch 29 by the press-on member 14, or after completion of a drive-in process when the drive-in tool 10 is lifted off the workpiece U. The motor 71 has a driving gear 75 connectable with the driving roller 72. The driving roller 72 is rotatably supported on a longitudinally adjustable arm 78 of servo means 76 formed as a solenoid. The servo means 76 is connected by an actuation conductor 77 with the control unit 23. The adjustment of the arm 78 is effected by the servo means 76 simultaneously with the start of the motor 71. During the operation, the driving roller 72 rotates in a direction shown with a dash arrow 73 for displacing the drive-in ram 13 against the drive spring member 31 for preloading the same. When the drive-in ram 13 reaches its preloaded, drive-in-ready position (FIG. 1), the pawl 51 of the locking device 50 engages the locking surface 53 on the drive-in ram 13, retaining the drive-in ram 13 in its drive-in ready position 22. Then, the motor 71 can be turned off by the control unit 23, and the servo means 76, which is also controlled by the control unit 23, displaces the driving roller 72 from its position in which it engages the driven means 75 and, accordingly, the drive-in ram 13, into a decoupled or disengaged position (not shown in the drawings).

When the drive-in tool 10 is pressed against the workpiece U, the press-on member 14 and the press-on switch 29 set the control unit 23 in a setting process-ready condition, and when a user actuates the actuation switch 19, the control unit 23 places the locking device 50 in its release position in which the servo motor 52 lifts the pawl 51 of the locking surface 53 on the drive-in ram 13.

As a result of the pawl 51 being lifted off the locking surface 53, the drive-in ram 13 is displaced by the drive spring member 31 in the drive-in direction 27, driving a fastening element 60 in the workpiece U (not shown in the Figures).

For displacing the drive-in ram 13 in its drive-in-ready position and for tensioning the drive spring member 31, at the end of the drive-in process, when the drive-in tool is lifted off the workpiece U, or later when the drive-in tool 10 is again pressed against the workpiece U, the preloading device 70 is again actuated by the control unit 23. To this end, the press-on switch 29 generates a signal that is communicated to the control unit 23. The control unit 23 again actuates the preloading device 70 that displaces the drive-in ram 13, in a manner already described above, against the biasing force of the drive spring member 31, again tensioning the drive-in spring member 31, until the pawl 51 can again engage the locking surface 53 on the drive-in ram 13 in the locking position 54 of the locking device 50.

The drive-in tool 10 also has a positioning device, which is generally designated with a reference numeral 40, for the transporting slide 63. The positioning device 40 is controlled by the press-on member 14 of the safety device 25. The positioning device 40, which will be described in more detail further below, can displace a fastening element, which is located in the receiving space 17 of the drive-in channel 16, from the receiving space 17 back in the guide channel 62 by displacing the transporting slide 63 and the carrier strip 65 with the fastening elements 60 against the biasing force of the transporting spring 64 upon lifting of the drive-in tool 10 off the workpiece U (see FIG. 2).

The positioning tool 40 has a tensioning device that contains a rope- or band-shaped tensioning element 48 and drive means 49 for the tensioning element 48. The drive means 49 is formed as an electric motor 94 on the output shaft of which a take-up spool 95 for the tensioning element 48 is arranged. The end of the tensioning element 48 remote from the take-up spool 95 is connected with the transporting slide 63. For guiding the tensioning element 48 from the transporting slide 63 toward the take-up spool 95, there is provided a deflection roller 96.

The actuation of the electric motor 94 is controlled by the press-on member 14 and/or the press-on switch 29 via the control unit 23. To this end, there are provided control conduits (not shown). The press-on member 14 and the press-on switch 29 can form as a unitary functional unit.

In FIG. 1, the press-on member 14 is in its press-on position 37 in which the press-on switch 29 is actuated by the press-on member 14. In the press-on position 37 of the press-on member 14, the positioning device 40 is not active and is in its neutral position 39. Therefore, the transporting slide 63 is able to transport a fastening element 60*a* into the receiving space 17 of the drive-in channel 16, holding it there. Accordingly, a setting process becomes possible.

In FIG. 2, the drive-in tool 10 is lifted off the workpiece U, without a drive-in process being initiated before the lifting-off. The press-on member 14, together with the press-on switch 29, are displaced in their initial position 36. The positioning device 40 is actuated by the control unit 23 and is displaced into its biasing position 38 in which the electric motor 94 rotates the take-up spool 95 in the direction of the third arrow 97. A predetermined length of the tensioning member 48 is wound onto the take-up spool 95, and the transporting slide 63 is displaced in the direction of the fourth arrow 98 against the biasing force of the transporting spring 64, displacing the carrier strip 65, together with the fastening element 60*a* which is located in the receiving chamber 17 of the drive-in channel 16, whereby the fastening element 60*a* is displaced out of the receiving chamber 17. In the biasing position 38 of the positioning device 40, the tensioning element 48 can be retained in its position by a locking device (not shown) that locks the take-up spool 95 that can be rotated only by the electric motor 94 in one of the two possible rotational directions. Thus, in the biasing position 38, the positioning device 40 keeps the drive-in channel 16 empty.

If the drive-in tool 10 is not actuated upon expiration of a predetermined time period, the time switch 59*a* actuates the locking device 50 which is displaced in its release position 55, releasing the projection 58 of the drive-in ram 13. The drive-in ram 13 is displaced in its initial position, and the drive spring member 31 can be displaced in its release position 34 (as shown in FIG. 2). The fastening element 60 is not ejected because before the positioning device 40 displaced the transporting slide 63 in the direction opposite the transporting direction of the fastening elements 60, whereby the drive-in channel 16 and the receiving space 17 became empty. The time switch 59*a* can likewise actuate the servo means 76 so that even before the displacement of the locking means 50 in its release position 55, the driving roller 72 becomes engaged with both the drive-in ram 13 and driving gear 75. Thus, upon release of the pawl 51, the motor 71 functions as braking means for the drive-in ram 13 displaceable in the setting direction. Thereby, with a corresponding design of the motor 71, of the control unit 23, and/or of the electrical components and parts of the drive-in tool 10, the electrical energy can be extracted and fed to the power source 21 in which it is stored. In this way, the motor 71 functions not only as a brake but also as a generator.

Advantageously, the locking device 50 is displaced in its release position 55 by the time switch 59*a* only then when the press-on switch 29 is in its initial position 36.

When the user turns the drive-in tool 10 completely off with the main switch 59*b* (see position of the switch 59*b* in FIG. 2 shown with dash lines), then with the main switch 59*b* which also functions as a further switch for the locking device 50, via the control unit 23, the servo means 76 with the driving roller 72 are adjusted, and the locking device 50 is displaced in its release position 55. Thereby, the drive spring member 31 can be also displaced in its release position 34, as it was discussed above. Alternatively, or in addition to the main switch 59*b*, e.g., a main switch (not shown in the drawings), which is formed as an electrical or mechanical sensor, can be arranged on the receptacle of the power source 21 or of the accumulator. This sensor likewise functions as a further switch for the locking device 50 and detects when the power source 21 or the accumulator is taken out of the receptacle. Thus, the accumulator or battery functions as a main switch within the spirit of the invention, opening the power circuit when being taken out of the receptacle. The release of the drive spring member takes place immediately and is effected with the residual energy remaining in the electrical system or available in the control unit 23.

Further, alternatively or in addition to other switch means, the press-on switch 29 (or an additional press-on switch) can function as switch means for the locking device 50 for displacing the same in its release position 55 when the drive-in tool 10 is lifted off the workpiece U.

The positioning device 40 can have instead of tensioning means, a counter-slide for the transporting slide 63 which, e.g., is mechanically connected with the press-on member 14 by a link drive. The movement of the press-on member 14 along the axis A can be converted into the movement of the counter-slide along the guide axis F which is defined by the guide channel 62. The movement of the counter-slide would lead to displacement of the transporting slide 63 against the biasing force of the transporting spring 64.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held drive-in tool for driving fastening elements (60) in a workpiece (U), comprising a guide (12); a drive-in ram (13) for driving the fastening elements (60) in the workpiece (U); at least one drive spring member (31) for driving the drive-in ram (13); a preloading device (70) for the drive-in ram (13) and the drive spring member (31); a locking device (50) having a locking position (54) in which the locking device (50) retains the drive-in ram (13) and the drive spring member (31) in a preloaded position (33), an actuation switch (19) for initiating a drive-in process and for displacing the locking device (50) into a release position (55) thereof; and at least one further switch for displacing the locking device (50) into the release position thereof (55) independent from actuation of the actuation switch (19).

2. A drive-in tool according to claim 1, wherein the at least one further switch is an electric switch for controlling the electrically actuated locking device (50).

3. A drive-in tool according to claim 1, wherein the at least one further switch is a time switch (59*a*).

4. A drive-in tool according to claim 3, wherein the time switch (59*a*) is an analogue electronic timer.

5. A drive-in tool according to claim 3, wherein the time switch (59*a*) is a digital electronic timer.

6. A drive-in tool according to claim 3, wherein the time switch (59*a*) is part of the control circuit (23) of the drive-in tool (10).

7. A drive-in tool according to claim 1, wherein the at least one further switch is a main switch (59*a*) that turns the drive-in tool (10) on and off.

8. A drive-in tool according to claim 1, wherein the preloading device (70) functions, in addition to preloading of the drive-in ram (13) and the drive spring member (31), as braking means for the drive-in ram.

9. A drive-in tool according to claim 1, further comprising a press-on switch (29) for generating a control signal and having an initial position (36) and an actuation position (37) in which it generates a control signal, the locking device (50) being displaceable in the release position (55) thereof upon actuation of the at least one further switch only when the press-on switch (29) occupies the initial, non-actuating position (36) thereof.

10. A drive-in tool according to claim 1, wherein the at least one further switch is a press-on switch (29) having a non-actuated initial position (36) and an actuated position (37) in which it generates a control signal.

* * * * *